US005897735A

United States Patent [19]

Peskin

[11] Patent Number: 5,897,735

[45] Date of Patent: Apr. 27, 1999

[54] METHOD FOR PRODUCING A DECORATIVE DESIGN LAMINATE FOR APPLICATION TO A SUBSTRATE UTILIZING AN EMBOSSING RESIN

[76] Inventor: Dennis L. Peskin, 222 Dogwood Trace, Tarpon Springs, Fla. 34689

[21] Appl. No.: 09/003,179

[22] Filed: Jan. 5, 1998

Related U.S. Application Data

[63] Continuation-in-part of application No. 08/586,194, Jan. 16, 1996.

[51] Int. Cl.[6] ..... B44C 1/165

[52] U.S. Cl. ..... 156/230; 156/235; 156/240; 156/241

[58] Field of Search ..... 156/235, 239, 156/240, 241, 230

[56] References Cited

U.S. PATENT DOCUMENTS

| | | | |
|---|---|---|---|
| 4,383,878 | 5/1983 | Young et al. | 156/235 |
| 4,557,961 | 12/1985 | Gorges | 428/117 |
| 4,693,926 | 9/1987 | Kowalski et al. | 428/204 |
| 4,983,487 | 1/1991 | Gilreath | 430/126 |
| 5,031,773 | 7/1991 | Manico et al. | 206/455 |
| 5,186,787 | 2/1993 | Phillips et al. | 156/631 |
| 5,304,413 | 4/1994 | Bloom et al. | 428/215 |

*Primary Examiner*—David A. Simmons
*Assistant Examiner*—J. A. Lorengo
*Attorney, Agent, or Firm*—James E. Larson; Larson & Larson, P.A.

[57] ABSTRACT

A carrier having a layer of embossing resin deposited thereon is provided with an image or design applied to the layer of embossing resin. A top film having a layer of adhesive applied thereon is laminated to the carrier. The carrier can be a throw-away or a component type carrier. If a throw-away type carrier is employed, it is peeled from the two laminated sheets, leaving the layer of embossing resin, having the image retained thereon, affixed to the adhesive side of the top film. If a component type carrier is employed, the image retained on the embossing resin is encapsulated between the top film and the carrier. Thereafter, a substrate suitable for aircraft interior panels is provided. The top film having the embossing resin and image affixed thereto is laminated to the suitable substrate. If a texture is desired, a textured material may be applied to the top side of the top film immediately before it is laminated to the suitable substrate. After subsequent lamination, the textured material is removed leaving a textured pattern in the finished component decorative laminate.

19 Claims, 4 Drawing Sheets

METHOD FOR PRODUCING A DECORATIVE DESIGN LAMINATE FOR APPLICATION TO A SUBSTRATE UTILIZING AN EMBOSSING RESIN

PRIOR APPLICATIONS

This application is a continuation-in-part of application Ser. No. 08/586,194, filed Jan. 16, 1996.

BACKGROUND OF THE INVENTION

1. Field of the Invention

This invention relates to a method for producing a decorative design laminate. More particularly, it relates to a novel method for producing a decorative design laminate from a computer generated image or design, transferring such image from a carrier to a substrate utilizing an embossing resin. Even more particularly, the novel method of the present invention relates to decorative design laminates for application to substrates suitable for aircraft interior panels.

2. Description of Prior Art

In the prior art, the most commonly used printing process known for aircraft applications, specifically for aircraft interior decorative laminates, is silk-screening. Unfortunately, silk-screening has a variety of inherent disadvantages. For instance, alterations of a design are difficult, costly, and time intensive, since each alteration, even the most minute, requires the creation of entirely new sets of screens. Each color alteration normally requires employing the costly and lengthy process of (1) color mixing and matching, (2) creating complete "laboratory" samples, and (3) creating the full-size production design. The full-size production design must be consistent with the laboratory sample. Multi-colored screens are even more expensive and time-consuming, regardless of whether "spot-color" silk-screening is used or four-color process silk-screening. Like other forms of prior art, silk screening is most economical, absorbing set-up costs, when large quantities are run, but such large "runs" often compromise color consistency. Moreover, in the aircraft decorative interior market, large quantities of a single design are relatively rare.

Other known processes which are used to decorate laminates for aircraft interior products include gravure printing, the use of integrally colored materials such as ABS (a type of vinyl), or the use of a solid color film laminated to a substrate. The inherent disadvantages of these processes are that they (1) limit the design to virtually one or two colors, (2) they limit customization of the design which often identifies the airline, and (3) they are most effectively produced in large quantities small "runs" being expensive and essentially cost prohibitive.

Various prior art methods exist for inclusion of digitally produced images in laminates, but non are suitable for aircraft laminates. One such prior art method is known as the "wet-method." An image is digitally created and printed electrostatically onto a transfer medium using heat and pressure. The image is mirrored, introducing the possibility for error. The image is then immersed in water, and using pressure, applied to a second film, from which the transfer medium is stripped.

U.S. Pat. No. 3,350,254 to Morgan et al. discloses a wet method utilizing a mixture of oil, resin and an elastomer. An exposed water soluble surface of the paper is washed away by wetting. In U.S. Pat. No. 3,350,254, a clay is used on the water soluble surface. Thereafter, the printed image remains adhered to the layer formed by the mixture. The transferred image is washed and dried. A protective laminate, such as transparent vinyl, having an adhesive side is often applied over the image to form a protective layer. The limitations with this method are: (a) there are additional steps (i.e., the wet transfer itself), drying time, and (b) this method is not generally amenable with materials used in aircraft interior decorative laminates that conform to government regulations of aircraft performance standards. This method is also considered messy and laborious.

In an effort to improve image transfer processes, a "dry" method was discovered eliminating many of the messy and laborious disadvantages of the "wet" method. This dry method uses heat and/or pressure to transfer an image printed on transfer paper to a chosen substrate. The transferred image is then overlaid with a protective film and secured with an adhesive. In this type of "dry" method a mirrored or negative image may have to be printed on the transfer paper. Such is shown in U.S. Pat. No. 3,013,917 to Karlan, et al. Such dry methods also have inherent disadvantages. For instance, they are considered slow and unreliable. If parts of the image do not transfer, the total image is ruined. High rejection rate causes extensive material waste, increased production cost, and waste of human resources. The particular overlay materials in typical aircraft products such as Tedlar are especially difficult to use with the "dry" transfer method since Tedlar will not readily accept the image.

In an effort to improve the "dry" transfer method, it was discovered that a pressure-sensitive adhesive-coated film could be used to lift the image from the transfer paper and thereafter secured to a final substrate. Such is shown in U.S. Pat. No. 4,983,487 to Gilreath wherein the adhesive coated film is shown to be the transfer medium. Unfortunately, the Gilreath invention also has many inherent disadvantages. One disadvantage is that the adhesive-coated film, used as the transfer medium, must be highly transparent so that the image may be viewed when applied to the final substrate. Use of a non-transparent film to capture the image would frustrate the purpose of the invention in that the image would not be viewable once it is applied to the final substrate. A second disadvantage is that textures can not be introduced. Since nowhere in Gilreath does the invention contemplate the use of an embossing resin, the laminate would not have the texture retention capabilities necessary for aircraft products. A third disadvantage is that Gilreath may have to be practiced utilizing a mirrored image. Use of such mirrored images provides for possible transfer error. Fourth, the Gilreath invention would most likely not meet many of the strict government regulations or aircraft performance standards due to the use of standard adhesives which can be highly flammable. Finally, Gilreath does not contemplate the use of an inkjet or airbrushed produced image. Therefore, the Gilreath invention is limited in its application to electrostatically produced images.

An improved "dry" method for creating design laminates is needed which can overcome the many disadvantages of the prior art. Such method should be able to meet the strict government and aircraft performance standards so that such design laminate can be used in aircraft interiors.

SUMMARY OF THE INVENTION

I have invented an improved transfer method for creating a decorative design laminate for the specific use in the aircraft industry. In particular, my laminates can be applied to aircraft interior panels. My method primarily uses electrostatic, inkjet, and airbrush digitally produced and printed images. Further, my method employs the use of an embossing resin (which may also serve as a color coat), as the receptacle for an image which has either been electrostatically printed and transferred to it, or which has been printed directly on it by way of inkjet or airbrush technology, a process not known in the prior art.

Embossing resins in the prior art are known for providing embossing or texture retention capabilities for the laminate, and sometimes for providing a background color coat on which to silk-screen. Nowhere in the prior art is it suggested that embossing resin could be used as the carrier for a digitally produced and printed image which can be incorporated into an aircraft worthy final laminate for application to aircraft interior parts and panels.

My invention takes advantage of digital printing, heretofore unknown and unused in the manufacture of aircraft interior decorative laminates. By doing so, complex images can be produced quickly and economically. Changes or alterations can be done without expensive and time-consuming creation of silk-screens. Design changes can be handled and reviewed remotely, without the creation of "laboratory samples." The method is well-suited for the typical quantities used in the aircraft interiors and can enhance and expand possibilities, heretofore thought of as either impossible or too expensive to be practical. My invention, furthermore, allows the product to meet the strict government regulations and aircraft performance standards.

My method produces a superior image, capable of more complex designs than the prior art. My method allows for alteration of the design more quickly and economically than the prior art. My process is better-suited for the quantities of prints typically ordered than the in prior art. Large "runs" are not necessary with my method. My method yields fewer rejects, thus reducing labor and material waste and is therefore more environmentally friendly. My process meets or improves the products ability to satisfy government regulations or aircraft performance standards. For example, my product with a complex image is lighter in weight than a comparable design produced by silk-screen.)

In my preferred method, first, a positive digitally produced electrostatic print is provided on a sheet of transfer paper. Secondly, a carrier having a layer of embossing resin deposited thereon is laminated to the transfer paper using heat and pressure such that the embossing resin contacts the image on the transfer paper. The transfer paper is peeled away, thus leaving the image retained on the embossing resin on the carrier. In alternate methods, the first and second steps are skipped and replaced with the single step of printing a digitally produced image by way of inkjet or computerized airbrush onto the surface of embossing resin deposited on the carrier. Thereafter, in all embodiments, a transparent film having an acceptable adhesive is then applied over the top of the image to protect the image. Next, the carrier is stripped away, leaving the embossing resin and image affixed to the over-laminate which is then joined with aircraft worthy substrates in a secondary lamination process. Or, the carrier for the embossing resin may be stripped away and the embossing resin with the image may be placed between aircraft worthy materials and laminated in a secondary laminating operation.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
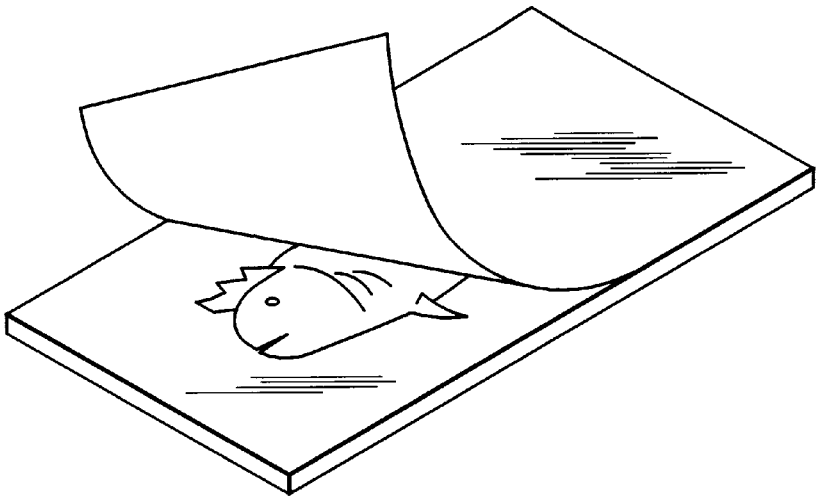
Fig. 1 PRIOR ART
FIG. 1 is a perspective view of a prior art image transferring dry method.
Figure 2:
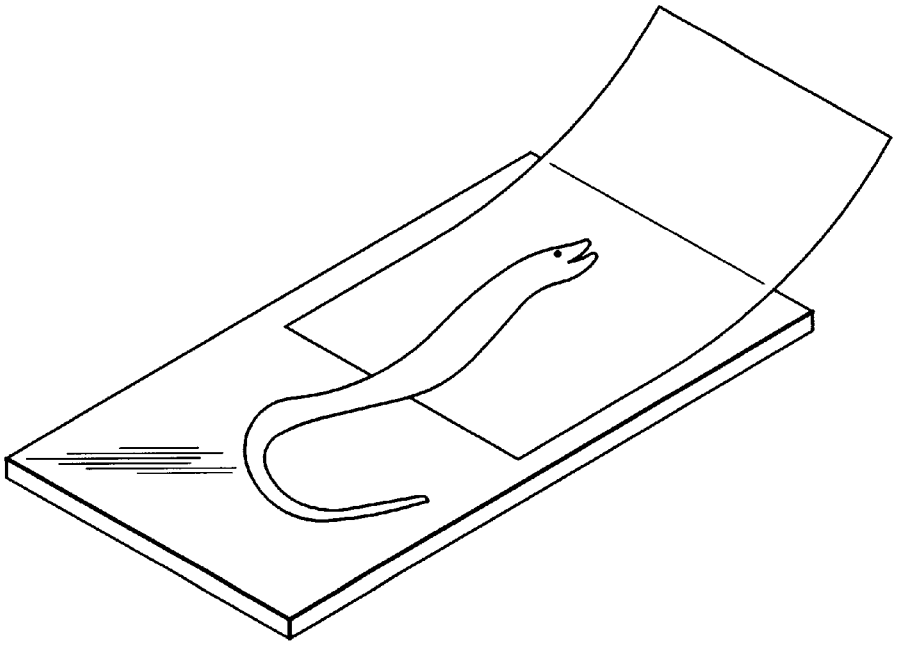
Fig. 2 PRIOR ART
FIG. 2 is a perspective view of a prior art image transferring wet method.

Throughout the following detailed description, the same reference numerals refer to the same elements in all figures.

The method of the present invention is primarily used to create decorative design laminates for application to aircraft interior panels and structures, although application to other substrates can be affected. The preferred method employs is electrostatically printed images, although alternate methods employ inkjet and airbrush produced images. The present methods uses an embossing resin as means for transferring the printed image from a carrier to the target substrate.

Figure 3:
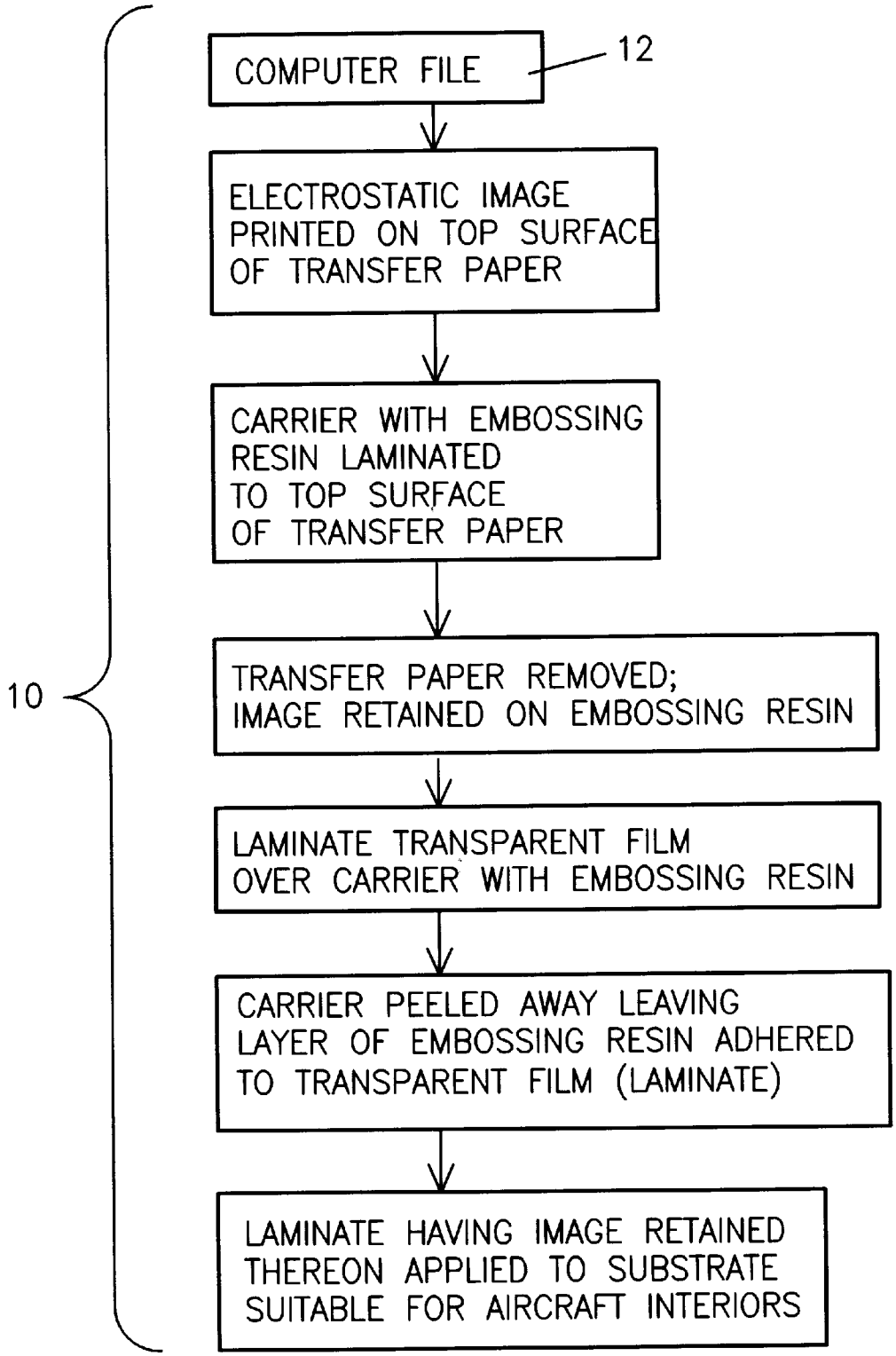
FIG. 3 is a block diagram of the preferred method of the present invention.

Referring to FIG. 3, a block diagram 10 depicts the steps carried out in the novel method of the present invention. In addition, FIG. 3 represents the preferred embodiment of the present invention. A computer file 12 contains a four color process image. The image is electrostatically printed on a sheet of transfer paper by a four color electronic printing system such as a Xerox® Plotter 8954. The image or design is printed as a positive image for direct transfer. The use of a mirrored image is not required in the method of the present invention, although a mirrored, or negative, image can be used. The transfer paper used is a normal transfer medium such as Wearcoat® manufactured by Xerox®. A carrier having a layer of embossing resin deposited thereon is laminated to the transfer paper such that the layer of embossing resin contacts the image printed on the transfer paper. Heat and/or pressure is applied. The transfer paper is removed, or peeled off, leaving the image or design retained within the layer of embossing resin of the carrier. A film having an adhesive side is applied to the carrier paper such that the adhesive side of the film contacts the layer of embossing resin encapsulating the printed image therein. Pressure and/or heat is again applied. In the preferred embodiment, the film is a clear Tedlar® laminate. Other materials can be used for the film, such as,polyethylene, polyester, Lexan® (a polycarbonate), Kynar®, or coated and non-coated vinyls. If a throw-away type carrier is employed, as in the preferred embodiment, the carrier is peeled from the top film leaving the layer of embossing resin, retaining the image therein, adhered to the top film or laminate. If a non-throw-away type carrier is employed, as in an alternate method, the carrier remains adhered to the laminate as a component of the complete laminate, encapsulating the image between the top film and carrier. Finally, a substrate suitable for aircraft interior applications is provided, whereby the complete laminate is laminated to such substrate. Heat and/or pressure can be employed to facilitate such lamination. If necessary, a layer of adhesive can be applied to the suitable substrate prior to laminating to the substrate.

Alternate methods employ either an inkjet or airbrush produced image or design. In such alternate methods, the use of the transfer paper is eliminated. Accordingly, the computer image utilizing an inkjet printer or an airbrush delivery system is printed directly to the carrier having the layer of embossing resin deposited thereon. The steps of the preferred embodiment are thereafter practiced through to the lamination of the laminate to the substrate. As in the preferred method employing the electrostatically produced image, the alternate method employing either the inkjet or airbrush produced image can use a throw-away or component type carrier.

Figure 4:
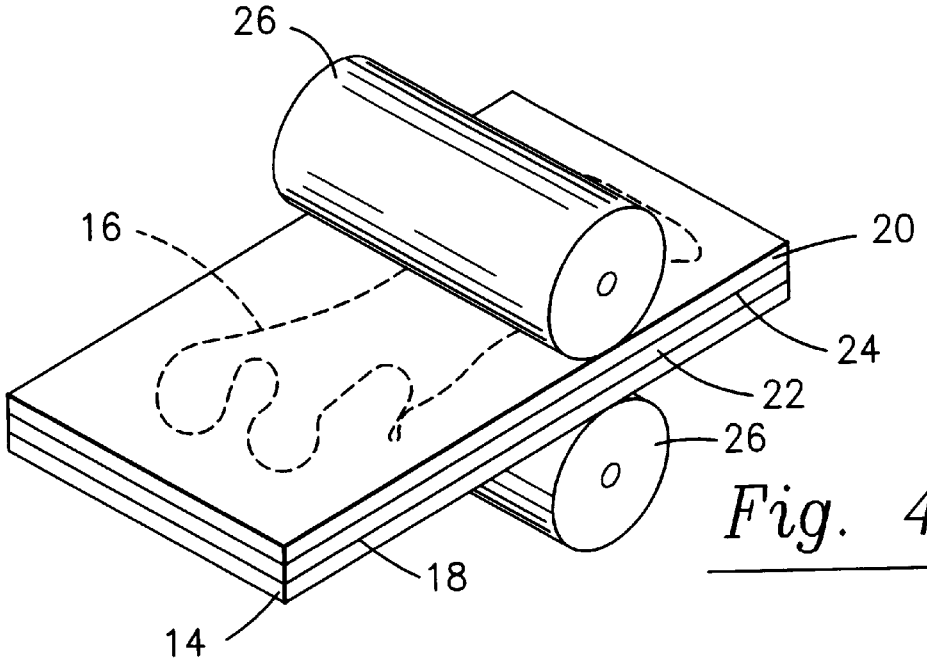
FIG. 4 is a perspective view of a transfer sheet having an image printed thereon being laminated to a layer of embossing resin deposited on a carrier as practiced in the present invention.

Referring to FIG. 4, a sheet of transfer paper 14 having an image 16 printed on a top side 18 of transfer paper 14 is applied to a carrier 20 having a layer of embossing resin 22 on a bottom side 24 of carrier 20. Transfer paper 14 with carrier 20 positioned together, as shown in FIG. 4, is passed through rollers 26 of a continuous laminator 25 at a speed ranging from 1.0–1.3 fpm. In addition, heat in the range of 290° Fahrenheit and pressure in the range of 120 psi (or more) is applied as transfer paper 14 and carrier 20 pass through continuous laminator 25. In an alternate embodiment, a flat bed laminator is used in place of the continuous laminator.

Figure 5:
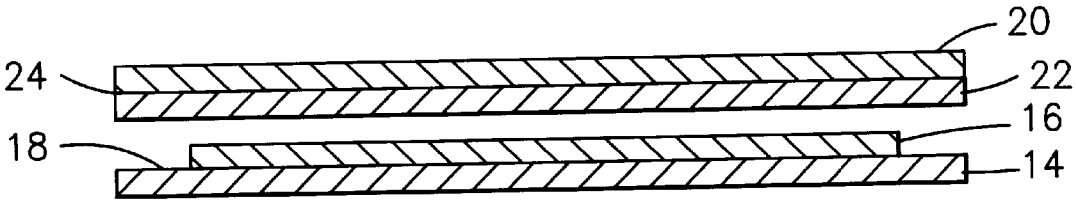
FIG. 5 is a cross-sectional view of the materials of FIG. 4 as being applied.
Figure 6:
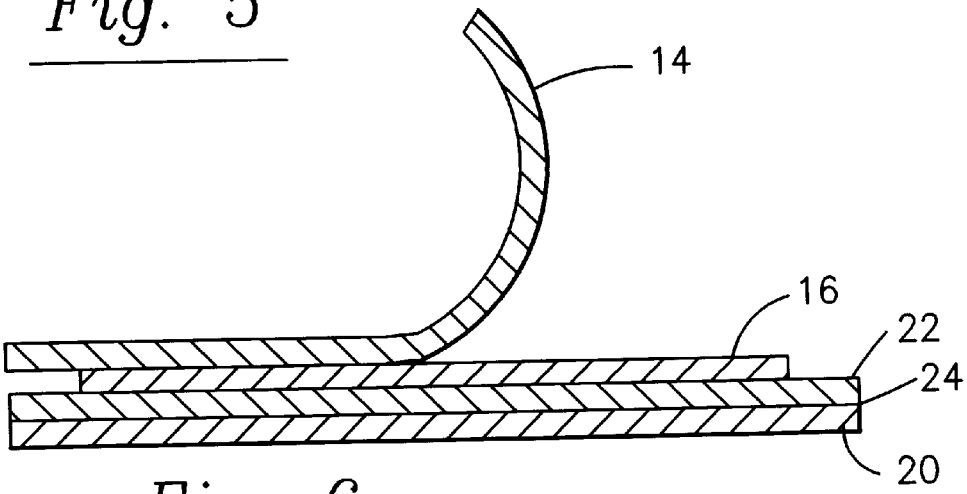
FIG. 6 is a cross-sectional view of the materials of FIG. 4 as the transfer sheet is being removed.
Figure 7:
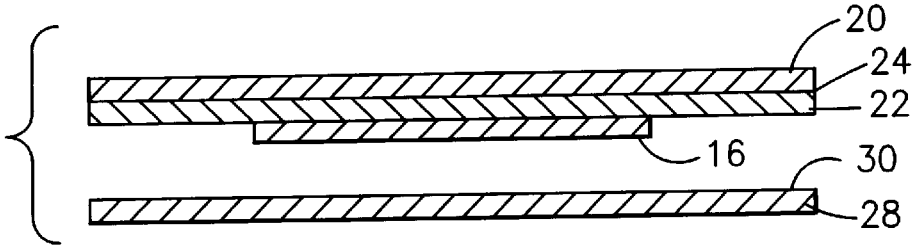
FIG. 7 is a cross-sectional view of the carrier having the image retained by the embossing resin on a bottom surface of the carrier, the carrier being applied to a top film.
Figure 8:
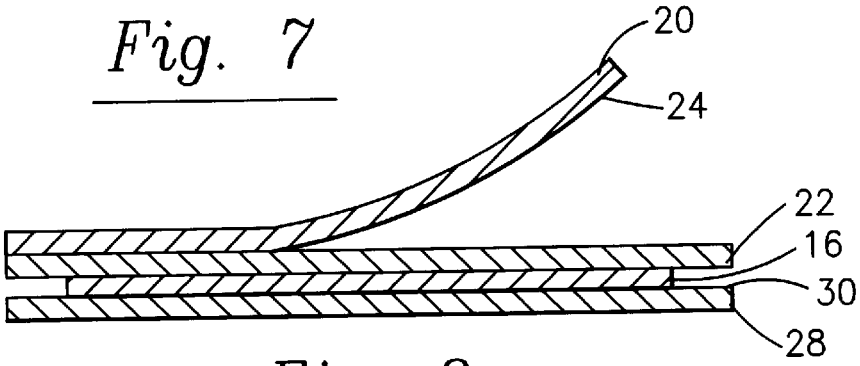
FIG. 8 is a cross-sectional view of the carrier having the image retained by the embossing resin on a bottom surface of the carrier, the carrier being removed after the carrier was laminated to a top film.
Figure 9:
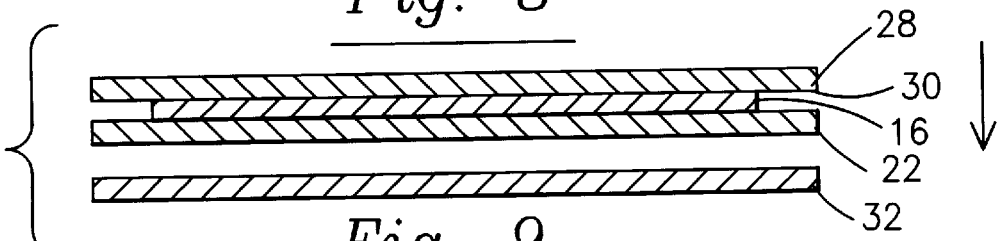
FIG. 9 is a cross-sectional view of the top film having the layer of embossing resin contained thereon, the image retained within the embossing resin, the top film being applied to a suitable substrate.

FIG. 5, a cross sectional view of the materials being used in FIG. 4, shows transfer paper 14 having image 16 printed on transfer paper top side 18 being applied to carrier 20 having a layer of embossing resin 22 provided on carrier bottom side 24. Referring to FIG. 6, after heat and/or pressure has been applied to transfer paper 14 and carrier 20, transfer paper 14 is peeled away from carrier 20. Layer of embossing resin 22 of carrier 20 retains image 16 on carrier bottom side 24. Referring to FIG. 7, carrier 20 retaining image in layer of embossing resin 22 on carrier bottom side 24 is laminated to a top film 28 on a bottom side 30 using a continuous laminator. Speed in the range of 1.0–1.3 fpm, heat in the range of 290° Fahrenheit, and pressure in the range of 120 psi (or more) are applied in the aforementioned step. Again, an alternate embodiment permits a flat bed laminator to be used for the carrier to top film lamination step. Referring to FIG. 8, carrier 20, in the preferred embodiment, is removed, leaving image 16 and layer of embossing resin 22 adhered to top film 28 on bottom side 30. Referring to FIG. 9, top film 28 retaining image 16 in layer of embossing resin 22 on bottom side 30 is laminated to substrate 32 suitable for aircraft interior applications.

Figure 10:
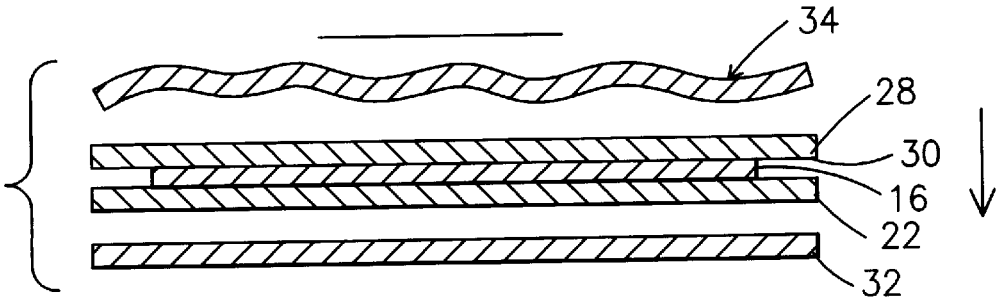
FIG. 10 is a cross-sectional view of top film having the layer of embossing resin contained thereon, the image retained within the embossing resin, the top film being applied to a suitable substrate along with a layer of textured material on a top side of the top film.
Figure 11:
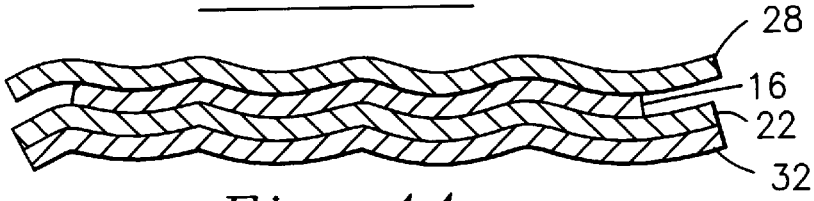
FIG. 11 is a cross-sectional view of a finished decorative design laminate having a textured design introduced therewithon.

If introducing a texture to the finished decorative design laminate is desired, such can be accomplished by practicing an alternate method of the present invention. Referring to FIG. 10, prior to laminating top film 28 to substrate 32, a layer of textured material 34 is applied to a top side 36 of top film 28. After lamination, textured material 34 is removed, leaving the finished decorative design laminate with a textured pattern, as seen in FIG. 11.

Prior to laminating top film 28 to suitable substrate 32, it may be advantageous to insert a layer of adhesive therebetween. If so desired, an extra tight bond can be achieved by inserting an intermediate clear layer of double sided adhesive tape (not shown) such as Opticlear®. Double sided adhesive tape utilizes a PSA (pressure sensitive adhesive).

In the preferred embodiment, substrate 32 can be any material desired which is used in the display of graphic art and prints but suitable for aircraft interior applications. Certain flame and smoke retardant regulations may apply. When using the continuous laminator, it is necessary that the material be able to move therethrough. Such materials include, polyester, polyethylene, Tedlar®, Kynar®, Lexan®, or coated and non-coated vinyls. If it is necessary to mount the substrate laminated finished image to a second substrate, the laminated substrate used can be provided with an adhesive back side for mounting to the second substrate. The component and finished decorative design laminate is applied to various areas within an aircraft interior. Such areas include, but are not limited to, the bulkheads, window panels, overhead bins, flooring, galleys, and lavatories.

Once the finished component decorative design laminate is created, it is possible to combine other image creation and transfer methods with the novel design laminate of the present invention. For example, the decorative design laminate can have a silk-screened image printed on top of the laminate. Other desirable results include, but are not limited to, metallic, pearlescent, and day-glo effects.

Equivalent steps and elements can be substituted for the ones set forth above to achieve the same results in the same manner.

Having thus described the invention what is claimed and desired to be secured by Letters Patent is:

1. A method for producing a decorative design laminate for application to a substrate suitable for aircraft interior panels utilizing an embossing resin, the steps comprising, (a) providing a sheet of transfer paper having an image printed on a top side, (b) providing a carrier having a layer of embossing resin deposited thereon, (c) laminating, utilizing heat and pressure, the sheet of transfer paper to the carrier such that the image printed on the transfer paper top side contacts the embossing resin deposited on the carrier, (d) removing the sheet of transfer paper from the carrier such that the image is transferred from the sheet of transfer paper to the embossing resin deposited on the carrier, (e) providing a top film having an adhesive applied on a bottom side, (f) laminating, utilizing heat and pressure, the top film to the carrier such that the embossing resin having the image retained thereon contacts the top film adhesive bottom side, (g) providing a substrate suitable for aircraft interiors, and (h) laminating, utilizing heat and pressure, the top film to the aircraft interior suitable substrate such that the embossing resin having the image retained thereon is encapsulated between the top film and the aircraft interior suitable substrate.

2. The method of claim 1, wherein the image printed on the transfer paper is electrostatically produced.

3. The method of claim 1, wherein a transparent component carrier is provided.

4. The method of claim 1, wherein immediately after step (f), further comprising the step of, (a) removing the carrier such that the embossing resin having the image retained thereon remains adhered to the top film bottom side.

5. The method of claim 1, wherein immediately step (g), further comprising the steps of, (a) providing a textured material, and (b) applying the textured material to a top side of the top film.

6. The method of claim 5, wherein immediately after laminating the top film to the aircraft interior suitable substrate, further comprising the step of, (a) removing the textured material.

7. The method of claim 1, wherein immediately after step (g), further comprising the step of, (a) applying a layer of adhesive on a top side of the aircraft interior suitable substrate.

8. The method of claim 7, wherein the layer of adhesive applied to the top side of the substrate suitable for aircraft interiors is a double-sided adhesive sheet.

9. The method of claim 1, wherein the substrate suitable for aircraft interiors is selected from the group consisting of polyvinylchloride, polycarbonate, polyvinylfluoride, fiberglass, and aluminum.

10. A method for producing a decorative design laminate for application to a substrate suitable for aircraft interior panels utilizing an embossing resin, the steps comprising, (a) providing a carrier having a layer of embossing resin deposited thereon, (b) printing an image directly to the carrier upon the layer of embossing resin, (c) providing a top film having an adhesive applied on a bottom side, (d) laminating, utilizing heat and pressure, the top film to the carrier such that the embossing resin having the image retained thereon contacts the top film adhesive bottom side, (e) providing a substrate suitable for aircraft interiors, and (f) laminating, utilizing heat and pressure, the top film to the aircraft interior suitable substrate such that the embossing resin having the image retained thereon is encapsulated between the top film and the aircraft interior suitable substrate.

11. The method of claim 10, wherein the image printed on the transfer paper is selected from the group consisting of an inkjet and airbrush produced image.

12. The method of claim 10, wherein a transparent component carrier is provided.

13. The method of claim 10, wherein immediately after step (d), further comprising the step of, (a) removing the carrier such that the embossing resin having the image retained thereon remains adhered to the top film bottom side.

14. The method of claim 10, wherein immediately after step (e), further comprising the steps of, (a) providing a textured material, and (b) applying the textured material to a top side of the top film.

15. The method of claim 14, wherein immediately after laminating the top film to the aircraft interior suitable substrate, further comprising the step of, (a) removing the textured material.

16. The method of claim 10, wherein immediately after step (e), further comprising the step of, (a) applying a layer of adhesive on a top side of the aircraft interior suitable substrate.

17. The method of claim 16, wherein the layer of adhesive applied to the top side of the substrate suitable for aircraft interiors is a double-sided adhesive sheet.

18. The method of claim 10, wherein the substrate suitable for aircraft interiors is selected from the group consisting of polyvinylchloride, polycarbonate, polyvinylfluoride, fiberglass, and aluminum.

19. A method for producing a decorative design laminate for application to a substrate suitable for aircraft interior panels utilizing an embossing resin, the steps comprising, (a) providing a sheet of transfer paper having an image printed on a top side, (b) providing a carrier having a layer of embossing resin deposited thereon, (c) laminating, utilizing heat and pressure, the sheet of transfer paper to the carrier such that the image printed on the transfer paper top side contacts the embossing resin deposited on the carrier, (d) removing the sheet of transfer paper from the carrier such that the image is transferred from the sheet of transfer paper to the embossing resin deposited on the carrier, (e) providing a top film having an adhesive applied on a bottom side, (f) laminating, utilizing heat and pressure, the top film to the carrier such that the embossing resin having the image retained thereon contacts the top film adhesive bottom side, (g) removing the carrier such that the embossing resin having the image retained thereon remains adhered to the top film bottom side, (h) providing a substrate suitable for aircraft interiors, (i) providing a textured material, (j) applying the textured material to a top side of the top film, (k) laminating, utilizing heat and pressure, the textured material and the top film to the aircraft interior suitable substrate such that the embossing resin having the image retained thereon is encapsulated between the top film and the aircraft interior suitable substrate, and (l) removing the textured material.

* * * * *